US005148682A

United States Patent [19]

Wolf

[11] Patent Number: 5,148,682

[45] Date of Patent: Sep. 22, 1992

[54] ICE MOLDING DEVICE AND METHOD

[76] Inventor: J. Davis Wolf, 2340 Walnut, Boulder, Colo. 80302

[21] Appl. No.: 695,959

[22] Filed: May 6, 1991

[51] Int. Cl.[5] ..... F25D 3/00

[52] U.S. Cl. ..... 62/59; 62/1; 62/60; 62/457.3; 62/457.4; 62/457.8; 220/625; 220/903; 249/83

[58] Field of Search ..... 62/1, 59, 60, 457.3, 62/457.4, 457.8; 220/625, 737, 903; 264/28, 301, 304; 249/83; 425/275

[56] References Cited

U.S. PATENT DOCUMENTS

| | | | |
|---|---|---|---|
| 662,541 | 11/1900 | Miskolczy | 62/331 |
| 1,943,384 | 1/1934 | Hall | 426/515 |
| 2,048,041 | 7/1936 | Warren et al. | 62/331 |
| 2,091,723 | 8/1937 | Sterino | 62/331 |
| 2,629,515 | 2/1953 | Asplund | 62/1 |
| 3,864,935 | 2/1975 | Elson | 62/60 |
| 4,510,769 | 4/1985 | McClellan, Jr. | 62/457.8 |
| 4,543,801 | 10/1985 | Damiens | 62/1 |
| 4,625,518 | 12/1986 | Freedman | 62/1 |
| 4,960,225 | 10/1990 | Gillis | 220/737 |

*Primary Examiner*—Ronald C. Capossela
*Attorney, Agent, or Firm*—Harry M. Weiss

[57] ABSTRACT

This dislcosure is directed to a device and method for forming ice around a beverage container such as a bottle of liquor. An upper piece preferably shaped like the beverage container and hollow is connected to a lower base piece after inverting the hollow upper piece and after inserting both the beverage container and water surrounding the beverage container within the upper hollow piece. Freezing of the combined upper and lower pieces after reversing the pieces to an upright position with the upper piece on top causes ice to form around the beverage container. Removal of the hollow upper container leaves and ice clad beverage container which keeps the beverage i.e. liquor very cold for use.

1 Claim, 1 Drawing Sheet

ICE MOLDING DEVICE AND METHOD

BACKGROUND OF THE INVENTION

1. Field of the Invention

This invention generally relates to devices and methods used to cool beverages and, more particularly, this invention relates to devices and methods for cooling beverage containers and especially liquor bottles or any container holding a liquid that freezes at colder temperatures than water.

2. Description of Related Art

It is well known that many beverages are enjoyed by consumers when chilled. One way of chilling a beverage is to place ice cubes in a container (e.g., a glass) that holds the beverage. Another way to chill a beverage is to place the container holding the beverage in a refrigerator or freezer before consuming the beverage. Both of these methods of chilling a beverage have a common shortcoming in that their effects eventually dissipate, usually during the ordinary time that one would take to consume the beverage. For example, the ice cubes will often melt before the consumption of the beverage is complete. With the refrigeration method of cooling, the beverage container used outside of the refrigerator eventually warms to room temperature, as does the beverage. The ice cube method of cooling has the additional shortcoming of diluting the beverage with water, which can affect the taste of beverages other than water.

There have been a number of attempts in the prior art to design a device and method that permits continuous cooling of a beverage within a container. For example, U.S. Pat. No. 4,543,801 to Damiens discloses a cool beverage carafe server wherein a ring of ice is formed around a carafe whose overall configuration is critically important. The carafe disclosed in the Damiens patent must have an elongated neck which may conveniently be hand-held as a handle. In addition, it is required that the main body portion of the carafe have a bulbous shape such that it will retain a solid ice ring captured thereon in an encircling relationship. As disclosed in the Damiens patent, the user of that device must take the liquid desired to be cooled (e.g., alcohol) and pour it from its original container into the pre-formed carafe. After the carafe is filled with the liquid beverage, the bulbous body portion is placed down into a water-filled mold so that the water largely covers the bulbous portion. The carafe and mold are then placed in a freezer in a vertical position until the water freezes around the bulbous portion. Once the water is frozen, the carafe is removed from the mold and utilized in conjunction with a tray that can collect ice drippings as the ice ring melts.

Another attempt at designing an apparatus for continuously cooling a beverage is shown in U.S. Pat. No. 2,048,041 to Warren et al. The Warren patent discloses a method and apparatus for serving ice drinks wherein a mold in the shape of a truncated cone is inverted and a glass for holding the beverage to be cooled is placed in an inverted position therein. The mold is filled with ice and turned back over into an upright position. After the ice hardens around the glass, the mold is removed, leaving a glass surrounded by an ice ring in the shape of a truncated cone. This Warren patent does not suggest how to cool a bottle of liquor and it is difficult to grip the ice ring clad glass.

Some other attempts at designing a device to perform a similar function are shown in U.S. Pat. No. 2,091,723 to Sterino, U.S. Pat. No. 1,943,384 to Hall and U.S. Pat. No. 662,541 to Miskolczy.

These patents do not disclose a device that easily permits an ice mold to be formed directly around the original and unopened container in which the beverage is packaged. For example, if one wanted to form a mold around an originally-manufactured glass bottle containing vodka caped or enclosed therein, none of the devices disclosed in these patents would work very well to achieve that objective. Moreover, if one wanted to similarly prepare a number of bottles at one time and in one freezer, there is very little flexibility in the position that these devices can rest in while ice is forming around the container. Moreover, there is less than an optimum amount of stability in these devices. If one were to bump the device disclosed in the Damiens patent, water could easily spill out of the mold and adversely affect the performance of the device.

SUMMARY OF THE INVENTION

Accordingly it is an object of this invention to provide a device and method that permits formation of an ice mold around a variety of different shapes of bottles, including the bottles originally utilized by the manufacturer of various beverages such as alcohols and liquors.

It is another object of the present invention to provide a device and method that permits the formation of an ice mold around a beverage container where the device can be placed in a number of positions and still permit the ice to form.

Still another object of the present invention is to provide a device and method that has greater stability than prior devices and methods previously used in this field, in particular before the ice actually forms from water.

Yet another object of the present invention is to provide a new and improved method including use of a mold for permitting formation of ice around a beverage container.

These and other objects can be achieved by my invention which comprises a two piece mating mold. The first (lower) piece is a base comprising a side wall connected to an end plate wherein the end plate has one or more projections directly toward the open end of this base piece and upon which projections a container (such as a liquor bottle) can rest. A second (upper) piece houses the bulk of the container and comprises an elongated preferably hollow structure closed at one end and opened at the other. This structure is preferably shaped in the same general configuration as the container to be iced, and includes a means for connection to or mating with said first piece. The means for connecting to or mating with said first piece can be a threaded portion or a snapping portion or any means sufficient to create a seal that prevents water leakage.

BRIEF DESCRIPTION OF THE DRAWINGS

This invention, in view of the above and other objects, features, aspects and advantages, is more easily understood when viewed in conjunction with the accompanying drawings.

DESCRIPTION OF THE PREFERRED EMBODIMENTS

Figure 1:
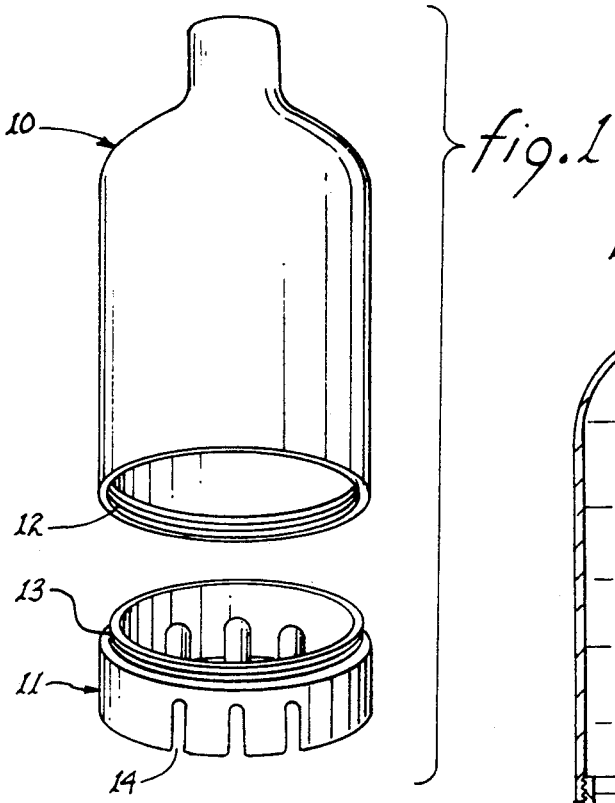
FIG. 1 shows an exploded side elevational view of the two pieces which comprise the device and method of this invention.

Referring to FIG. 1, the present invention is shown as comprising two pieces or components. An upper piece 10 is preferably made from a molded plastic wherein the upper piece is preferably of a shape that generally follows the exterior shape of the container to be iced. The upper piece 10 must be of sufficient length or height so that upon inversion of the piece 10 and after insertion therein of the beverage container to be iced, a substantial portion of the beverage container will be covered by water. A lower (base) piece 11 is of a shorter height than the elongated upper piece 10 and preferably includes one or more upwardly extending projections 14 upon which the bottom portion of the beverage container (e.g., liquor bottle) can rest (see FIGS. 2 and 3).

Both the upper piece 10 and lower piece 11 can be designed to both include a means for mating with each other, however, if desired, only one of the upper or lower pieces can comprise a means for mating with the other piece. A common threaded arrangement, which permits the upper piece 10 and lower piece 11 to be screwed together, is one means for mating the two pieces. Threads 12 on upper piece 10 and threads 13 on lower piece 11 provide for such a mating or connection.

Figure 2:
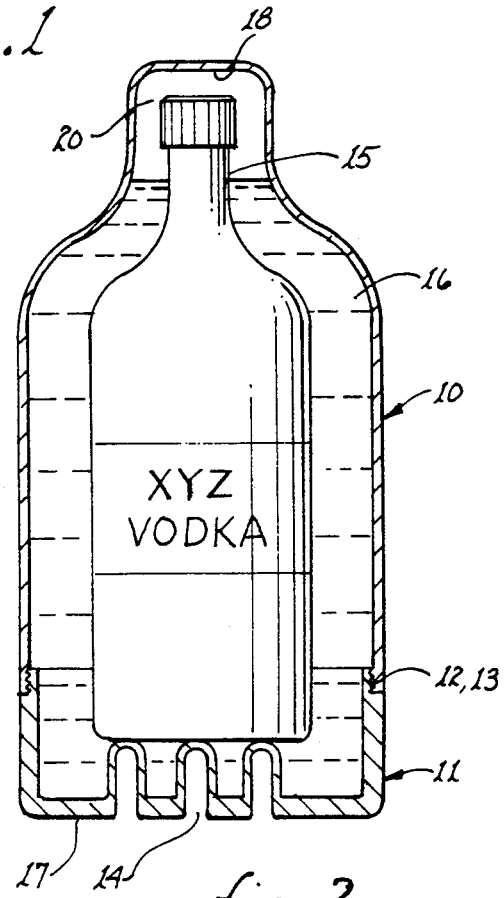
FIG. 2 shows a side elevational sectional view of the present invention (of FIG. 1) after preparation which includes enclosing a beverage container surrounded by water and before placement in a freezer with the upper water line lowered to the position shown.

FIG. 2 shows the present invention after assembly and before insertion in a freezer. Upper piece 10 is first inverted so that the open end thereof is facing up in the air. Thereafter, a liquor bottle 15 or other container to be wrapped in ice is inverted with the enclosed or caped pouring end down and thus placed within the inverted upper piece 10. After the container 15 is placed in this position, water is poured in around the space between the interior wall of the upper piece 10 and the exterior surface of the container 15. Since upper piece 10 is elongated to cover substantially all of container 15, there will nearly enough ice formed around container 15 to cover substantially the entire container 15. After water 16 is poured between the container 15 and the inner wall of the upper piece 10, the lower piece 11 is mated with the upper piece 10 (still in an inverted position) so that a water tight seal is created between the two pieces. Thereafter, the upper piece 10 and lower piece 11, as a single entity is turned back into an upright position and the container 15 comes to rest on the one or more inwardly direct projections 14 emanating from cylindrical end plate 17 of the lower piece 11. In addition, the water 16 flows downwardly when the two piece entity is in the upright position and fills up the hollow portions within the generally cylindrically shaped base piece 11 around the projections 14 thereby creating an air space 20 between upper surface 18 of the upper piece 10 and water line 19. However, this space 20 is only created in this location when the two piece unit is placed in a vertical, upright position within a freezer. The air space 20 permits expansion of the ice being formed during the ice freezing operation as well as to preferably permit access to remove the cap of the beverage container. As is apparent, this air space 20 will rise to the vertical-most (upper end) location within the two piece container depending upon the position the container is placed in for freezing. Since the volume of the air space 20 is comparatively small with respect to the volume of the water 16, the location of the air space 20 is generally not a great concern toward the successful utilization of my invention.

Figure 3:
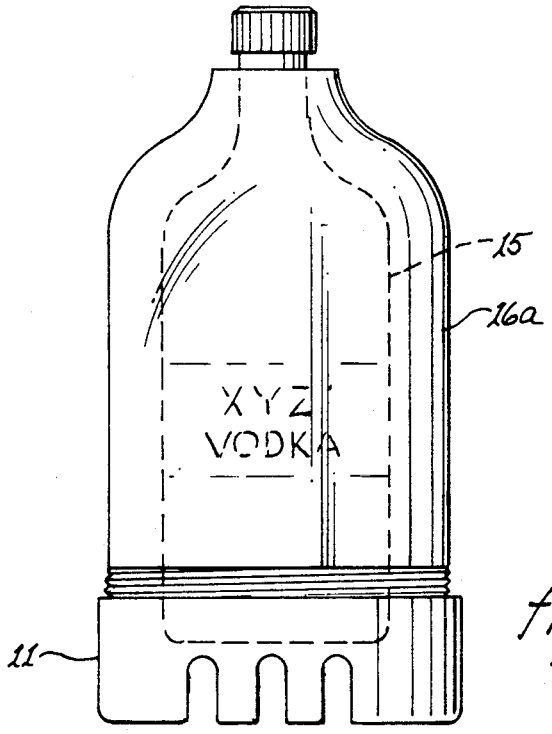
FIG. 3 shows an ice enclosed beverage container having an exterior ice formation in the same general shape as the container after freezing the enclosed beverage container wherein the container and ice formation reside within the second (upper) piece of my invention which is mounted on the generally cylindrical base (first piece) with projections emanating therefrom.

FIG. 3 shows the beverage container 15 surrounded by ice **16*a* after having been assembled as in FIG. 2 and placed in a freezer. After the freezing operation is completed, the generally elongated upper (mold) piece 10 is disengaged (i.e. by unscrewing) from the lower piece 11 and is removed as a sleeve from the ice 16*a*. The lower piece 11 is preferably left in place so as to provide a hand grip for the bottom of the combined container/ice amalgamation as shown in FIG. 3. However, it is certainly possible to remove the lower piece 11** if that is desired.

Accordingly, it is apparent from the foregoing detailed description and illustrative drawings that I have invented an ice molding device which satisfies the objectives and achieves the advantages stated throughout this specification. Other variations and modifications of this invention may be made by those skilled in the art without departing from the scope of the invention defined by the claims herein.

What is claimed is:

1. A method for forming ice around a beverage container comprising the steps of:

providing a lower piece;

providing a hollow upper piece mold means for coupling to said lower piece;

inserting a beverage container and water into the interior of said hollow upper piece mold means after inverting said hollow upper piece mold means;

attaching said lower piece to said hollow upper piece mold means to seal an open end of said hollow upper piece mold means;

reversing the combined hollow upper piece mold means with the attached lower piece to an upright position with said lower piece on the bottom;

freezing the combined hollow upper piece mold means with the attached lower piece in a freezer to form ice around substantially an exterior portion of said beverage container; and removing said hollow upper piece mold means to provide an ice clad beverage container.

* * * * *